United States Patent [19]

Spescha

[11] 4,049,211

[45] Sept. 20, 1977

[54] WINDING APPARATUS FOR TEXTILE THREADS

[75] Inventor: Gelli Spescha, Winterthur, Switzerland

[73] Assignee: Rieter Machine Works, Ltd., Winterthur, Switzerland

[21] Appl. No.: 738,086

[22] Filed: Nov. 2, 1976

[30] Foreign Application Priority Data

Nov. 5, 1975 Switzerland ..... 14252/75

[51] Int. Cl.[2] ..... B65H 59/38

[52] U.S. Cl. ..... 242/45

[58] Field of Search ..... 242/45, 18 DD, 75.5, 242/75.51, 65

[56] References Cited

U.S. PATENT DOCUMENTS

| | | | |
|---|---|---|---|
| 2,438,722 | 3/1948 | Stenge | 242/45 X |
| 3,180,584 | 4/1965 | Blunck | 242/45 |
| 3,281,087 | 10/1966 | Claiborne | 242/45 X |
| 3,931,938 | 1/1976 | Hasegawa | 242/45 |

*Primary Examiner*—Edward J. McCarthy

*Attorney, Agent, or Firm*—Kenyon & Kenyon, Reilly, Carr & Chapin

[57] ABSTRACT

The speed of the friction drive drum is electronically controlled as a function of the thread speed. The apparatus allows winding of a precision wound package or a random wound package. The apparatus employs an electronic control unit which calculates a desired value signal for the speed of the drive drum as a function of the thread speed from a mathematical formula and compares this value to the actual value in order to obtain a correction signal for the drive of the drive drum. A similar calculation is also made for controlling the speed of the traversing thread guide shaft.

14 Claims, 3 Drawing Figures

WINDING APPARATUS FOR TEXTILE THREADS

Figure 1:
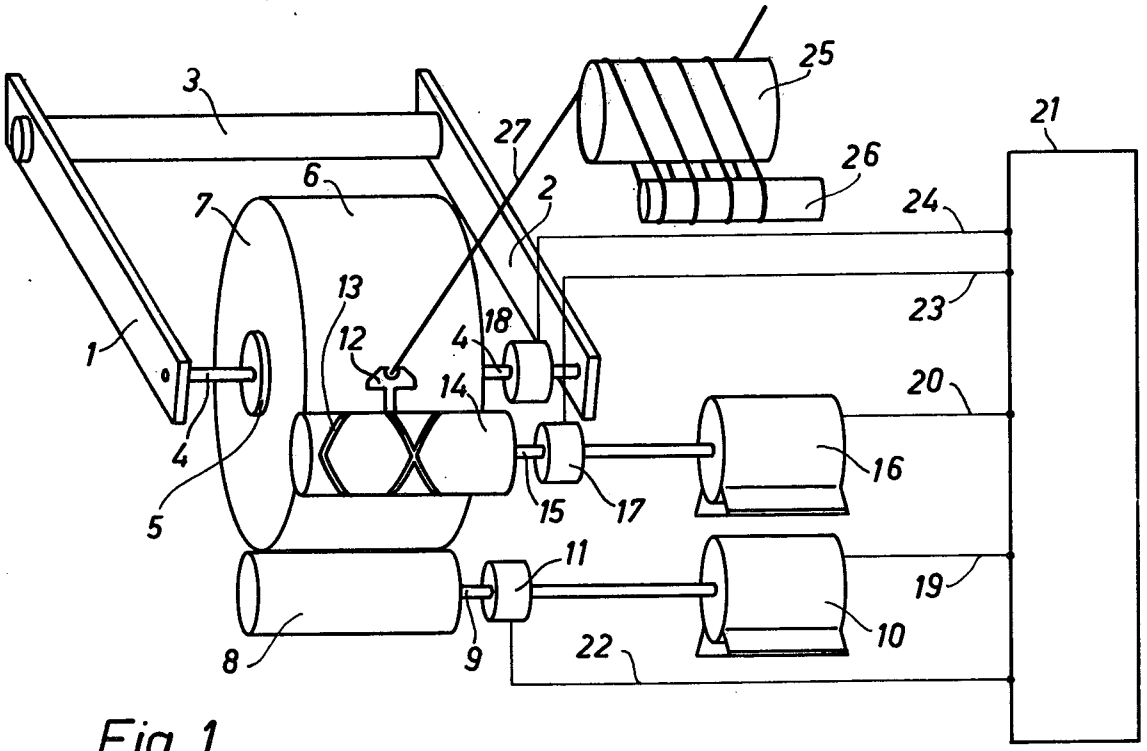

This invention relates to a winding apparatus for textile threads and particularly to a winding apparatus for forming bobbin packages of endless filaments via the use of a friction drum drive.

As is known, there are two types of winding devices for producing cross-wound packages in practical use. A first type is suitable for producing cross-wound packages of the random or wild wound type and generally contain a friction drive drum which drivingly contacts the surface of a cross-wound bobbin package placed on a freely rotatable bobbin chuck. The winding device also employs a traversing thread guide to distribute the thread over the bobbin package surface. As an alternative, the friction drive drum has sometimes been used as a traversing thread guide. In this case, the thread to be wound along the bobbin package surface is traversed by means of a groove in the drum, i.e., a grooved drum.

However, this type of winding device is not applicable for the production of random wound cross-wound bobbin packages, i.e., of bobbin packages in which the ratio of the number of revolutions per time unit to the number of complete traversing cycles per time unit (traversing ratio) varies constantly. This is because the bobbin package diameter increases and the corresponding number of revolutions per time unit decreases while the number of complete traversing cycles per time unit is maintained constant. Also, the distance between the thread of a winding layer to the thread of the subsequent winding layer can change over time and can even become zero, in which case, the position of the thread of one winding layer coincides with the position of the thread of the subsequent winding layer. This causes the formation of the so-called pattern formation on the surface of the bobbin package which is much dreaded in practical operation. Consequently, a number of pattern breaking or scrambling measures are taken to counteract this condition.

As is known, the formation of patterns can be avoided on fast running winding devices as used in the man-made industry, by using very complicated control systems for the friction drive drum and for the traversing thread guide. However, this can be achieved only by incurring other disadvantages, such as uneven winding tension in the thread to be wound. Such tension variations in the thread of a cross-wound bobbin package can cause difficulties in further processing. Furthermore, the random winding arrangement is unsuitable for winding threads of circular cross-section. This is because these threads tend to roll off due to the uneven deposition of the winding layers onto the surface of the cross-wound package. A further disadvantage of the random winding arrangement resides in that in processing coarse, voluminous threads such as e.g., carpet yarns, only cross-wound bobbin packages of relatively low weight and low density or hardness can be produced. Such cross-wound bobbins are disadvantageous for subsequent processing steps and, in many cases, the bobbins cannot be used.

These disadvantages relative to winding technology of the random winding devices can be overcome by a second type of winding machine, namely winding devices which produce precision wound cross-wound bobbin packages.

In a precision wound arrangement, the above mentioned traversing ratio, sometimes referred to as winding ratio, is maintained substantially constant over the whole package build-up. In order to achieve this, the to and fro motion of the traversing thread guide is synchronized strictly with the rotational movement of the bobbin chuck. Thus, the known winding devices for precision winding are provided with driven bobbin chucks instead of a friction drive for the cross-wound bobbin package. Synchronization between the bobbin chuck and the traversing thread guide in the known winding devices of this type is effected by mechanical coupling of both elements. The crossing angle of the windings thus continuously decreases as the bobbin package diameter increases. In order to ensure that the crossing angle does not become too small at the end of the bobbin package build, a relatively low traversing ratio is chosen at the beginning of the bobbin package build. Generally, this ratio requires a low number of revolutions per traversing cycle of the traversing thread guide, i.e., the traversing thread guide at the beginning of the package build must effect a relatively high number of complete cycles per time unit. However, this is limited mechanically.

The known winding devices of the type for precision winding thus present the important disadvantage that they are not applicable at the very high winding speed of 5,000 meters per minute and up, used today in the man-made fibers industry, because the admissible limit of traversing cycles per time unit is exceeded.

Accordingly, it is an object of the invention to eliminate the disadvantages mentioned of the known winding devices with friction drive drums for random winding and of the winding devices for precision winding.

It is another object of the invention to provide a winding apparatus which can be used for random winding or precision winding.

It is another object of the invention to provide a winding apparatus which can produce cross-wound precision-wound bobbin packages at winding speeds of 5,000 meters per minute and higher.

Briefly, the invention provides a winding apparatus for textile threads which comprise a rotatable bobbin chuck for forming a bobbin package, a friction drive drum for rotating a bobbin package on the chuck, a thread guide for guiding a thread to the bobbin chuck to form a bobbin package, and a helical groove shaft for moving the guide transversely of the chuck. In addition, separate drives each having a speed conrol are provided for rotating the friction drive drum and the helical groove shaft and an electronic control unit is provided to control the operation of the apparatus. This electronic control unit includes a means for calculating the rotational speed ($f_{RS}$) of the friction drive drum as a function of the thread speed in accordance with a mathematical formula which is exact or, at least, approaches exactness with a negligible deviation factor. This means receives the desired value of the thread speed ($V_F$) and the desired value of the rotational speed ($f_{CS}$) of the helical groove shaft while the speed control of the drive for the drive drum adjusts the speed of the drive drum in accordance with the calculated rotational speed.

In addition, a second means is provided for calculating the rotational speed ($f_C$) of the helical groove shaft as a function of the rotational speed of the bobbin package ($f_K$) in accordance with a second mathematical formula. This means receives a freely chosen momentaneous value of the winding ratio, i.e., the number of revolutions of the bobbin package to the number of cycles of the thread guide, and a freely chosen momentaneous value of the thread displacement from winding layer to winding layer.

Figure 2:
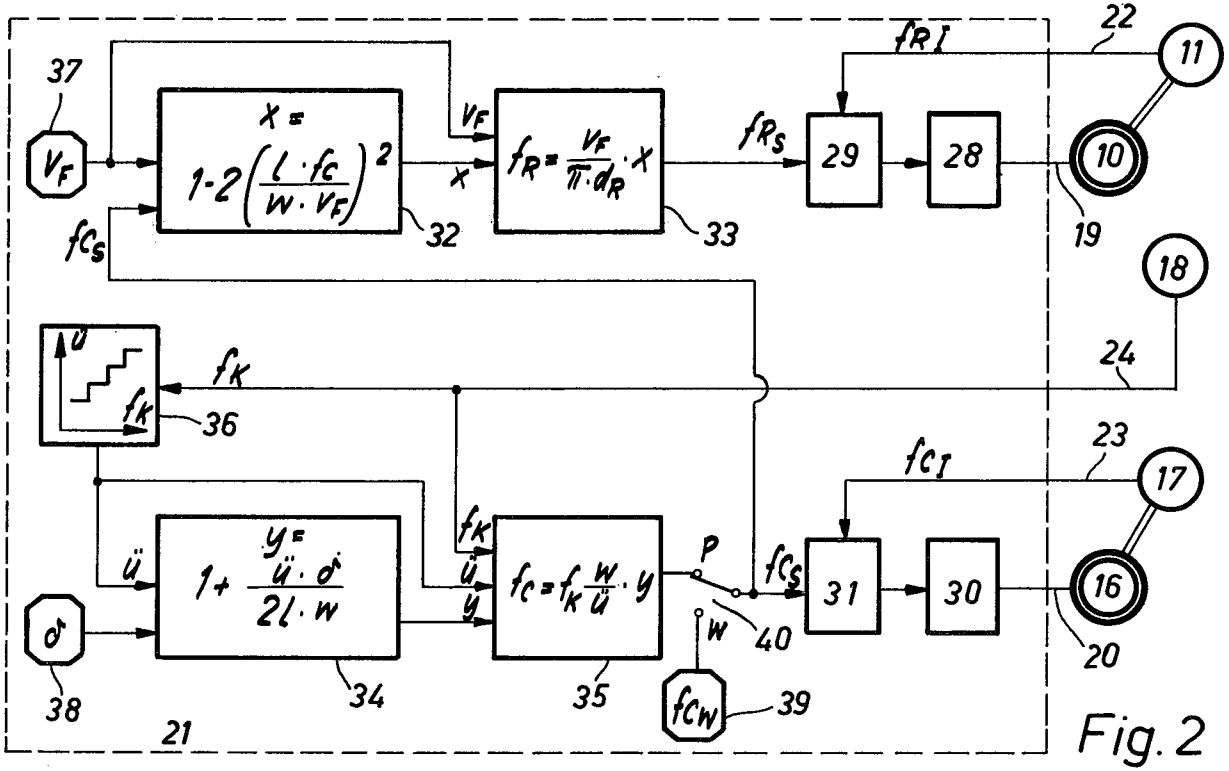
Figure 3:
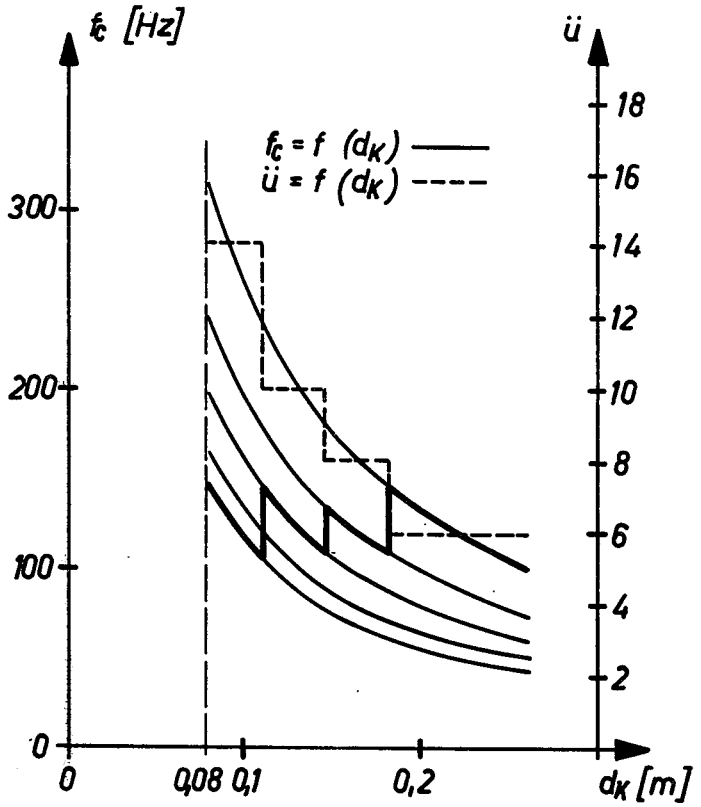

These and other objects and advantages of the invention will become more apparent from the following detailed description and appended claims taken in conjunction with the accompanying drawings in which:

FIG. 1 illustrates a schematic axonometric view of a winding apparatus in accordance with the invention;

FIG. 2 illustrates a circuit diagram indicating the circuit principle of the winding apparatus according to the invention; and FIG. 3 diagrammatically illustrates the thread traversing shaft rotational speed $f_C$ and of the traversing ratio $\ddot{u}$ as a function of the bobbin package diameter $d_K$ for a cross-wound bobbin package produced to a large extent as a precision wound package using the winding apparatus of FIG. 1.

Referring to FIG. 1, the winding apparatus includes a bobbin holder frame formed by two arms 1, 2 and a pivoting axle 3. This frame supports a rotatable bobbin chuck 4 which is disposed substantially parallel to the axle 3. The axle 3 is pivotably supported in a part of the machine (not shown) which is fixed relative to the room in which the machine is mounted in such manner that the bobbin holder frame including the bobbin chuck 4 can effect a pivoting movement about the axle 3. A bobbin tube 5 is slid onto the bobbin chuck 4 and the thread-to-be-wound is wound on the tube 5 in the form of a thread package 6 of cylindrical shape. The thread package 6 together with the bobbin tube 5 forms a so-called cross-wound bobbin package. This cross-wound bobbin package 7 contacts a driven friction drive drum 8 under the influence of its own weight. The drum 8 is arranged below the package 7 and frictionally rotates the bobbin package 7. Pressing elements (not shown) to press the cross-wound bobbin package 7 against the friction drive drum 8 for improved driving contact can also be provided. The position of the friction drive drum 8 relative to the cross-wound bobbin package 7 in this case can be chosen as desired. The friction drive drum 8 contains a rotational axle 9 which is rotatably supported in a non-shiftable part of the machine frame (not shown).

A drive for driving the friction drive drum 8 includes a motor 10, e.g., an asynchronous motor, as well as a speed control (FIG. 2) to adjust the speed of the motor 10 and, thus, the drum 8. A revolution meter 11, e.g., a digital tachometer, is also connected to the shaft 9 of the drum 8 and to the speed control.

A thread guide 12 is mounted in close vicinity to the cross-wound bobbin package 7 but not necessarily contacting the cross-wound bobbin package 7. This thread guide 12 traverses to and fro parallel to the bobbin chuck 4, the function of which is to guide the thread to and fro in axial direction along the bobbin package surface to form a bobbin package. The traversing thread guide 12 which can be shaped as an open slot (FIG. 1) or as a closed eyelet (not shown) is moved longitudinally by meshing with a traversing groove 13 of a so-called helical groove shaft 14. This shaft 14 is mounted on a shaft 15 which is rotatably supported in a fixed part (not shown) of the winding apparatus. The shaft 15 is rotatingly driven by a drive which includes an electric motor 16, e.g., by an asynchronous motor, and is connected to a second revolution meter 17, e.g., a digital tachometer for measuring the number of revolutions per time unit of the helical groove shaft 14 and thus the number of traversing cycles per time unit of the traversing thread guide 12. The function of this revolution meter 17 is explained below.

A third revolution meter 18, e.g., a digital tachometer is mounted on the bobbin chuck 4 to measure the number of revolutions per time unit of the bobbin chuck 4. The function of this meter 18 is also explained below. The motors 10, 16 are connected via electric circuits 19, 20 respectively with an electronic unit 21 of the winding apparatus and are supplied with current as well as controlled via these circuits. The revolution meters 11, 17 and 18 via electric circuits 22, 23 and 24 respectively are also connected with the control unit 21. The momentaneous value of the revolution number per time unit of the friction drive drum 8 and ofthe helical groove shaft 14 and of the bobbin chuck 4 respectively are transmitted via these circuits.

During operation, a thread 27 supplied by a supply device formed by a roll 25 and a separator roll 26, is caught by the traversing thread guide 12 and while a to and fro movement is effected, is placed onto the surface of the thread package 6 of the cross-wound bobbin package 7. During this time, the thread 27 is wound in the form of mutually crossing windings. The winding form of the thread windings on the surface of the cross-wound bobbin package, i.e., the momentaneous winding ratio, is determined by the mutual ratios of the number of revolutions per time unit of the friction drive drum 8, of the momentaneous diameter of the cross-wound bobbin package 7 and of the number of traversing cycles per time unit of the traversing thread guide 12.

By controlling the rotational speeds of the friction drive drum 8 and of the helical groove shaft 14 via the control unit 21, taking into account the naturally increasing diameter of the cross-wound bobbin package, a complete control of the winding conditions, i.e., of the form of the windings placed onto the bobbin surface, can be obtained.

Another important factor, namely the number of helical turns of the groove of the helical groove shaft 14, which also influences the winding conditions, is determined on a given type of winding apparatus and is considered as a constant. In order to describe the control function of the control unit 21, a deduction of the mathematical interrelations of the different factors of influence is required.

The following definitions are used in the description:

| | |
|---|---|
| $v_F$ | Speed of the thread in meters per second ($m \cdot sec^{-1}$) |
| $d_R$ | Diameter of the friction drive drum 14 in meters (m) |
| $d_K$ | Diameter of the cross-wound bobbin packages 7 in meters (m). |
| l | Width of the cross-wound bobbin package 7 in meters (m). |
| $\delta$ | Displacement of the thread, i.e. distance from thread center to thread center of two consecutive winding layers. $\delta$ is determined at right angles to the thread axis and is indicated in meters (m). |
| $f_K$ | Rotational speed of the cross-wound bobbin package 7 in revolutions per second ($sec^{-1}$). |
| $f_C$ | Rotational speed of the helical groove shaft 14 in revolutions per second ($sec^{-1}$). |
| $f_R$ | Rotational speed of the friction drive drum 8 in revolutions per second ($sec^{-1}$). |
| $\ddot{u}$ | Winding ratio. $\ddot{u}$ = a constant to yield a precision wound package, while $\ddot{u}$ = variable yields random wound package. |
| w | Number of winding turns of the groove 13 of the helical groove shaft 14, i.e. the number of revolutions of the helical groove shaft 14 per traversing cycle completed of the traversing thread guide 12. In FIG. 1, e.g. w equals 3. |

For a given winding device $d_R$, 1 and $w$ are determined mechanically, i.e. are to be considered as constant values.

$v_F$ is the lead value which can be either chosen as fixed or can be determined by the delivery speed of the supply device 25, 26.

Furthermore, $\ddot{u}$ and $\delta$ are parameters which can be chosen, i.e., values which can be chosen according to the type of winding (precision winding or random winding) and to the thread to be processed (thickness, softness, volume and the like).

Between the parameters mentioned above, the following mathematical relations prevail, as can be proven:

Equation 1: $$f_R \cong \frac{v_F}{d_R \cdot \pi} \cdot \frac{1}{\sqrt{1 + \left(\frac{2\ l}{\ddot{u} \cdot d_K \cdot \pi}\right)^2}}$$

and

Equation 2: $$f_c = \frac{v_F \cdot w}{d_K \cdot \pi \cdot \ddot{u}} \left[ \frac{1}{\sqrt{1 + \left(\frac{2\ l}{\ddot{u}\ d_K \pi}\right)^2}} + \frac{\ddot{u}\ \delta}{2\ l w} \right]$$

In equation (1) a very small correction term, caused by the thread displacement $\delta$, has been neglected. Thus, the equation is only approximately exact. The resulting error, however, is neglegible.

Furthermore, it is found:

Equation 3: $$d_K = \frac{f_R}{f_K} \cdot d_R$$

Application of equation (3) in the equations (1) and (2) yields the new equations for $f_R$ and $f_C$, respectively:

Equation 4: $$f_R = \frac{v_F}{d_R \cdot \pi} \cdot \sqrt{1 - \left(\frac{2\ l f_K}{\ddot{u}\ v_F}\right)^2}$$

and

Equation 5: $$f_c = f_K \cdot \frac{w}{\ddot{u}} \cdot \left[ 1 + \frac{\ddot{u}\ \delta}{2\ l\ w} \cdot \frac{1}{\sqrt{1 - \left(\frac{2\ l f_K}{\ddot{u}\ w_F}\right)^2}} \right]$$

According to these equations for $f_R$ and $f_C$, thus an analog or digital electronic computer can be built, which, as an element of the control unit 21 of FIG. 1, determines at each time moment the correct values desired of $f_R$ and of $f_C$ as a function of $f_K$ (and of $d_K$ respectively) for the parameters $\ddot{u}$, $\delta$ chosen.

The equations (4) and (5) can be simplified further, if it is taken into account that the following approximate relations prevail under actual processing conditions:

Equation 6: $$f_R \approx \frac{v_F}{d_R \cdot \pi}$$

Equation 7: $$f_C \approx f_K \cdot \frac{w}{\ddot{u}}$$

Thus, the equations (4) and (5) can be replaced by the following approximate equations of sufficient exactness:

Equation 8 $$f_R \cong \frac{v_F}{d_R \cdot \pi} \left] 1 - 2 \left(\frac{l f_K}{\ddot{u}\ v_F}\right)^2 \right]$$

Equation 9 $$f_C \cong f_K \cdot \frac{w}{\ddot{u}} \left(1 + \frac{\ddot{u}\ \delta}{2\ l\ w}\right)$$

Furthermore, it proves advantageous in the circuit lay-cut with respect to the actual computer lay-out, and to obtain an easy switching of the control unit from the precision winding mode to a random winding mode, to introduce the correction term of $f_R$ as a function of $f_C$ instead of as a function of $f_K$.

As equation (7) is applied in equation (8), the following new equation for $f_R$ is obtained:

Equation 10 $$f_R \cong \frac{v_F}{d_R \cdot \pi} \left[ 1 - 2 \left(\frac{l f_C}{w\ v_F}\right)^2 \right]$$

The chooseable parameter $\ddot{u}$ is also eliminated from this equation 10 to yield a further advantage in the circuit lay-out, as will be explained later.

Referring to FIG. 2, the control unit 21 includes the speed controls for each of the drum 8 and the shaft 14 as well as the control elements required for implementing the control of the winding apparatus. The speed control for the friction drive drum includes an invertor 28 and a control device 29 while the speed control for the helical grooved shaft 14 likewise includes an invertor 33 and a control device 31.

The control elements are in the form of computing elements 32 - 35, a program indicator unit 36, i.e., a function generator for the winding ratio $\ddot{u}$, a desired value indicator 37 for the thread speed $v_F$, a desired value indicator 38 for the thread displacement $\delta$ , a desired value indicator 39 for the rotational seed of the helical groove shaft 14 for the random winding mode $f_{CW}$ and a switch-over device 40 for the precision winding mode P and the random winding mode W.

Further values indicated in FIG. 2 are:

| | |
|---|---|
| $f_{CI}$ | Actual value of the rotational speed of the helical groove shaft 14 (FIG. 1) as transmitted by the revolution meter 17, |
| $f_{CS}$ | Desired value of the rotational speed of the helical groove shaft 14 (FIG. 1) as transmitted by the computing device 35, |
| $f_{RI}$ | Actual value of the rotational speed of the friction drive drum 8 (FIG. 1) as transmitted by the revolution meter 11, |
| $f_{RS}$ | Desired value of the rotational speed of the friction drive drum 8 (FIG. 1) as transmitted by the computing element 33. |

As can be seen from the schematic circuit diagraph according to FIG. 2, the two separate drives of the friction drive drum 8 (FIG. 1) (asynchron-motor 10, digital tachometer 11, invertor 28 and control device 29) and of the helical groove shaft 14 (FIG. 1) (asynchronmotor 16, tachometer 17, invertor 30 and control device 31), are so-called rigid rotational speed controlled systems with feed back, i.e., systems in which the actual value of the rotational speed is compared (in the control device 29, 31 respectively) continuously with a certain desired value which in the present case is computed and is adapted. Thus, an absolutely precise control of the rotational speed of the friction drive drum 8 and of the helical groove shaft 14 (FIG. 1) is ensured. This is of primary importance in producing cross-wound bobbin packages corresponding to the computer program.

Of course, other types of drives can also be provided for the friction drive drum 8 and for the helical groove shaft 14 (FIG. 1) without exceeding the scope of the invention. Thus, e.g., a drive arrangement using a synchronous motor or a high precision direct current motor (both not shown) can be used. In these cases, the use of the control device 29, 31, respectively, and of the tachometer 11, 17 respectively can be eliminated.

It should be mentioned here that the approximating equations (9) and (10) for the values $f_C$ and $f_R$, are valid in the case of the precision winding mode as well as in the case of the random winding mode. As a constant winding ration $u$ and a constant thread displacement $\delta$ can be chosen freely, the conditions for realizing a precision winding mode can be fulfilled. If $\ddot{u}$ and/or $\delta$ are variable, however, a random winding mode can be effected.

The control unit 21 shown in the schematic circuit diagram of FIG. 2 for the winding apparatus contains e.g., four computing elements 32 through 35. The computing elements 32 and 33 are coupled in series and are used for computing $fR$ according to the equation (10). For this purpose, the computing element 32 is supplied via the desired value indicator 37 with the desired value of the thread speed $v_F$ and with the desired value of the rotational speed of the helical groove shaft $f_C$. This later value $f_C$ is supplied either by the computing elements 34 and 35 coupled in series and used for computing $f_C$ according to the equation (9) or via the desired value indicator 39 for the random winding mode, or is supplied directly by the tachometer 17. The function of the desired value indicator 39 is described later on in more detail. First, the case is to be described, in which the switch 40 is in the position indicated in FIG. 2, i.e., in which a contact P is closed whereas a contact W is open. The calculation of $f_R$ according to equation (10) is effected in two steps. The first computing element 32 first supplies an intermediate function X which is further processed in the computing element 36. For this purpose, the computing element 33 is supplied with the desired value of the thread speed $f_F$.

In the equation (9) for $f_C$, the parameters $\ddot{u}$ and $\delta$ are used which can be chosen freely. For this purpose, the schematic circuit diagram according to FIG. 2 contains a function generator 36 to generate the value $\ddot{u}$ as a function of the rotational speed of the cross-wound bobbin $f_k$ and an indicator device 38 for the thread displacement $\delta$. The indicator 38 as shown in FIG. 2 is provided as an indicator device for a constant value of $\delta$. It is, however, possible to provide a function generator similar to the function generator 36 to generate the value $\delta$ as a function of $f_K$. If $\ddot{u} = f(f_K)$ = constant, and $\delta = f(f_K)$ = constant, a precision wound package is obtained automatically.

If $\ddot{u} = f(f_K)$ = constant is to be fulfilled, the function generator 36 for $\ddot{u}$ is supplied with the momentaneous, effective value of the rotational speed $f_K$ of the bobbin package from the revolution meter 18 via the circuit 24. The same momentaneous, effective value of $f_K$ is utilized in the second step of computing the equation (9) in the computing element 35.

The computed desired values $f_{RS}$ and $f_{CS}$ are transmitted to the control devices 29, 31 respectively, where they are compared with the effective values $f_{RI}$ and $f_{CI}$ transmitted from the tachometers 11, 17. The frequencies of the supply current for the asynchronous motors 10, 16 are controlled via the respective invertors 28, 30 in such manner that the effective values coincide with the corresponding desired values.

By using the switch 40, the computer part formed by the two computing elements 34, 37 for computing $f_{CS}$ according to equation (9) can be switched off and a value given by the indicator 39 for a rotational speed of the helical groove shaft at a random winding mode $f_{CW}$ can be applied for controlling the motor 16 as well as the computing element 32. By switching the switch 40 from P to W, any synchronization between the motor 10 of the friction drive drum 8 and the motor 16 of the helical groove shaft 14 is rendered impossible in such manner that the winding ratio $\ddot{u}$ is rendered variable by necessity. This results in a random winding mode on the cross-wound bobbin package. The indicating device of the desired value $f_{CW}$ of course can be laid out in such manner that the value $f_{CW}$ is made variable in order to avoid pattern formation on the surface of the cross-wound bobbin package during a random winding mode. Use of the control unit of the winding apparatus, thus allows a precision winding mode or a random winding mode to be achieved as desired. In the first case, $\ddot{u} = f(f_k)$ = constant is to be chosen by setting the switch 40 to the position P shown in FIG. 2. In the second case, the switch 40 is to be set to the position W.

In summary, when the apparatus is in operation, i.e., while winding the delivered thread 27 (FIG. 1) onto a bobbin package 7, a signal representative of the desired thread speed ($v_F$) from the indicator 37 and a signal representative of the desired rotational speed ($f_{CS}$) of the shaft 14 are delivered to the computing element 32. The element 32 then forms a signal representative of the value X and transmits the signal to the computing element 33. The computing element 33 also receives the signal representative of the thread speed ($v_F$) and emits a calculated signal representative of the desired rotational speed ($f_R$) in response to the control device 29. The control device 29 also receives a momentaneous signal representative of the actual speed of the drive drum 8 from the tachometer 11 and compares the two signals. Should the two signals not match, the control device 29 emits a correction signal to the inventor 28 and the inventor 28, in turn, delivers a signal to the motor 10 via the circuit 21 to adjust the speed of the motor 10. In this way, the speed control adjusts the drive so as to rotate the drum 8 at a speed to match the momentaneous signal with the calculated signal in the control device 29.

The signal representing the desired rotational speed of the shaft 14, as indicated in FIG. 2, can also be a calculated signal. To this end, a signal representative of thread deflection ($\delta$) is transmitted from the indicator 38 to the computing element 34 while a signal representative of a desired winding ratio ($\ddot{u}$) as a function of the rotational speed ($f_K$) of the bobbin package is transmitted from the function generator 36 to the computing element 34. The signal representing the bobbin package speed is delivered from the tachometer 18 via the circuit 24 to the function generator 36 as well as to the computing element 35. Next, the computing element 34 forms a signal representative of the value Y and transmits the signal to the computing element 35. The computing element 35 also receives the signal for the value ($\ddot{u}$) from the generator 36 and from the three received signals emits a calculated signal representative of the desired rotational speed ($f_{CS}$) for the helical groove shaft 14 to the control device 31 as well as to the computing element 32. The control device 31 also receives a momentaneous signal representative of the actual speed of the shaft 14 from the tachometer 17 via the circuit 23 and compares the two signals. As above, should the signals not match, a correction signal is transmitted to the invertor 30 and the motor 16 is adjusted so as to match the actual value signal with the calculated value signal in the control device 31.

The control unit shown in FIG. 2 furthermore permits a random winding mode to be effected in such manner that if the switch 40 is in the position P, a characteristic curve of $\ddot{u} = f(f_K)$ is chosen in the generator 36 in which $\ddot{u}$ is variable. The value $\ddot{u}$ can be controlled over the whole build of the bobbin package according to a certain function. The values of $f_R$ and $f_C$ computed by the computing elements 32 through 35, in this case, provide ideal operating conditions for the winding apparatus to produce a certain random wound package in such a manner that no "patterning" and also no variations in thread tension can occur.

Furthermore, using the function generator 36 for $\ddot{u} = f(f_K)$, a desired characteristic can be chosen in which $\ddot{u}$ remains constant over a certain time lag and at times, preferably in a jump function, is variable. During the time intervals over which $\ddot{u}$ is maintained constant, a layer of windings on the bobbin package is obtained in a precision wound mode, whereas at the times during which $\ddot{u}$ varies, a random winding mode is obtained. This possibility is of particular importance as the production of cross-wound bobbin-packages precision wound to a large extent at very high thread speeds $v_F$ is permitted. This task cannot be fulfilled by the known winding devices for precision winding due to the excessive number of traverse cycles of the traversing thread guide at small diameters $d_K$ of the cross-wound bobbin package.

Using the solution shown here, however, it is sufficient to choose $\ddot{u}$ high while $d_K$ is small at the beginning of the package build. Thus, the number of traversing cycles is reduced to within admissible limits. As the bobbin package diameter $d_K$ increases, the value $\ddot{u}$ can be reduced stepwise in one or a plurality of steps without problems. Thus, the crossing angle of the thread on the surface of the cross-wound bobbin package is prevented from becoming too small, which could result in sloughing off of windings. Due to this possibility, also at a very high $v_F$, a cross-wound bobbin package can be produced the windings of which are placed in precision wound layers with all the advantages of this winding mode cited initially. This embodiment is explained in more detail in the following with reference to an example using actual dimensions and values:

EXAMPLE:

According to the mathematical relations, the characteristic of the curve of $f_C$ as a function of the bobbin package diameter $d_K$ was computed using the winding ratio $\ddot{u}$ as a parameter. The results are shown in the diagram of FIG. 3. The computation was carried out for this example for the following case of dimensions closely related to practical application:

$v_F = 5000$ meters minute
$1 = 0.25$ meters
$w = 6$
$d_R = 0.12$ meters
$\delta = 0.002$ meters As parameters, $\ddot{u} = 6, 8, 10, 12, 14$ were chosen. The individual curves indicate the decrease of $f_C$, i.e., the slowing down of the speed of the traversing motion of the thread guide as the bobbin package diameter decreases while the winding ratio $\ddot{u}$ is maintained constant. This characteristic of $f_C = f(d_K)$ is disadvantageous as, at the beginning, $f_C$ is to be chosen very high. Thus, it proves advantageous not to maintain $\ddot{u}$ constant over the whole package build, but to reduce $\ddot{u}$ stepwise via the function generator 36 as a function of the bobbin package diameter $d_K$. In the diagram of FIG. 3, also the chosen characteristic of $\ddot{u} = f(d_K)$ is indicated with broken lines. The value $\ddot{u}$ is changed in three steps: 14, 10, 8 and 6. Due to these changes of the winding ratio, the corresponding curve $f_C = f(d_K)$ changes, as also indicated in the diagram of FIG. 3. This curve also becomes a discontinuous step function as shown with a thick, solid line. As can be seen, the variation of $f_C$ in this manner can be held within very narrow limits during the whole bobbin package build in such manner. Thus, in spite of the high thread speed $v_F$ of 5000 meters per minute, the number of revolutions per time unit $f_C$ of the helical groove shaft at the beginning of the bobbin package build (where $d_K = 0.080$ meters and $\ddot{u} = 14$) does not exceed about 140 revolutions per second. This corresponds to a practically applicable number of complete traversing cycles per second of about 24.

As $d_K$ has reached the value of 0.11 meters and as $f_C$ according to the curve $f_C = f(d_K)$ at $\ddot{u} = 14$ has diminished to about 105 revolutions per second, the function generator 36 reduces $\ddot{u}$ from 14 to 10. The value $f_C$ then adapts and jumps to the corresponding value $f_C =$ about 144 on the curve $f_C = f(d_K)$ at $\ddot{u} = 10$, i.e., to a value resulting in an admissible number of complete traversing cycles of the traversing thread guide. During the short lapse of time, during which $\ddot{u}$ does not remain constant, a thin layer of random wound windings is generated on the bobbin package surface. This, however, is of no consequence in further processing of the cross-wound bobbin package. The control process for adapting $\ddot{u}$ can be repeated several times (in the example of the diagram shown in FIG. 3, e.g. 3 times), in which a control process of course values of $\ddot{u}$ can be chosen which are not whole numbers. The cross-wound bobbin package to a large extent shows precision wound layers, the expression "to a large extent" being understood to indicate that the cross-wound bobbin package consists of a plurality of (4 in the example) of precision wound thread layers which are separated by thin random wound intermediate layers.

The most important advantages of the winding apparatus are:

1. The complete control of the thread tension problems during winding, due to the theoretically exact control of the speed of the winding elements;

2. The possibility to change simply, quickly and without mechanical change, the winding mode and in particular change from a precision winding to a random winding mode and thus to produce cross-wound bobbin packages ideally wound for further processing of any thread material;

3. The possibility of achieving to a large extent a precision wound cross-wound bobbin package at very high values of the thread speed $v_F$; and 4. The possibility of applying the controls on existing winding devices equipped with a friction drum drive and a separate variable drive for the friction drum and for the traversing thread guide in a simple and inexpensive manner.

The term "textile thread" is used herein as a generic term for yarns, filaments, threads, and the like structure normally used in the textile arts and particularly to those of the endless type.

What is claimed is:

1. A winding apparatus for textile threads comprising a rotatable bobbin chuck for forming a bobbin package thereon;

a friction drive drum for rotating a bobbin package on said chuck;

a thread guide for guiding a thread to said bobbin chuck to form a bobbin package;

a helical groove shaft for moving said thread guide transversely of said chuck;

a first drive having a speed control for rotating said friction drive drum;

a second drive having a speed control for rotating said helical groove shaft;

an electronic control unit including first means for calculating the rotational speed ($f_{RS}$) of said friction drive drum as a function of the thread speed in accordance with a mathematical formula, said means receiving the desired value of the thread speed ($V_F$) and the desired value of the rotational speed of said helical groove shaft ($f_C$) wherein said speed control of said first drive adjusts the speed of said friction drive drum in accordance with the calculated rotational speed ($f_{RS}$).

2. A winding apparatus as set forth in claim 1 wherein said control unit further includes a second means for calculating the rotational speed ($f_{CS}$) as a function of the rotational speed of the bobbin package ($f_K$) in accordance with a second mathematical formula, said second means receiving a freely chosen momentaneous value of the winding ratio of the number of revolutions of the hollow package to the number of cycles of said thread guide, and a freely chosen momentaneous value of the thread displacement from winding layer to winding layer.

3. A winding apparatus as set forth in claim 2 wherein said control unit includes a function generator for emitting said momentaneous value of the winding ratio $\ddot{u}$ as a function of the value of the rotational speed of the bobbin package ($f_K$).

4. A winding apparatus as set forth in claim 3 wherein said function generator is programmed according to a function of $\ddot{u} = f(f_K)$.

5. A winding apparatus as set forth in claim 4 wherein $u$ is a constant at least during a part of a whole package build.

6. A winding apparatus as set forth in claim 5 wherein the bobbin package is built in two parts with the winding ratio $\ddot{u}$ during the latter of said parts being changed from a first higher value to a second lower value.

7. A winding apparatus as set forth in claim 1 wherein said control unit includes an indicator for establishing the momentaneous value of the rotational speed of said helical groove shaft ($f_C$) for delivery to said first means.

8. A winding apparatus as set forth in claim 7 wherein said control unit further includes a second means for calculating the rotational speed ($f_{CS}$) of said helical groove shaft as a function of the rotational speed of the bobbin package ($f_K$) in accordance with a second mathematical formula, said second means receiving a freely chosen momentaneous value of the winding ratio of the number of revolutions of the bobbin package to the number of cycles of said thread guide, and a freely chosen momentaneous value of the thread displacement from winding layer to winding layer.

9. A winding apparatus as set forth in claim 1 wherein said control unit includes a plurality of computing elements arranged in series and/or parallel.

10. A winding apparatus for textile yarns comprising a rotatable bobbin chuck for forming a bobbin package thereon;

a friction drive drum for rotating a bobbin package on said chuck;

a thread guide for guiding a thread to said bobbin chuck to form a bobbin package;

a helical groove shaft for moving said thread guide transversely of said chuck;

a first drive having a speed control for rotating said friction drive drum;

a second drive housing a speed control for rotating said helical groove shaft;

at least one computing element for receiving a first signal representative of the desired thread speed ($V_E$) and a second signal representative of a desired rotational speed ($f_{CS}$) of said helical groove shaft, said element emitting a calculated signal representative of the desired rotational speed ($f_R$) for said drive drum in response to said first and second signals, said element being connected to said speed control of said first drive to deliver said calculated signal thereto; and a tachometer connected between said drive drum and said speed control of said first drive for delivering a momentaneous signal to said speed control representative of the actual speed of said drive drum for comparsion wtih said calculated signal whereby said speed control adjusts said first drive to rotate said drive drum at a speed to match said momentaneous signal with said calculated signal.

11. A winding apparatus as set forth in claim 10 wherein said speed control of said first drive includes a comparator for receiving said momentaneous signal and said calculated signal and for emitting a correction signal in response to a deviation between said received signals, and an invertor for receiving said correction signal to adjust said first drive in response thereto.

12. A winding apparatus as set forth in claim 10 wherein further comprises at least one computing element for receiving a first signal representative of a desired thread deflection, a second signal representative of a desired winding ratio ($\ddot{u}$) as a function of the rotational speed ($f_K$) of the bobbin package, and a third signal representative of the rotational speed ($f_K$) of the bobbin package, said element emitting a calculated signal representative of the desired rotational speed ($f_{CS}$) for said helical groove shaft; and a tachometer connected between said shaft and said speed control of said second drive means for delivering a momentaneous signal to said speed control representative of the actual speed of said shaft for comparison with said calculated signal whereby said speed control adjusts said second drive to rotate said shaft at a speed to match said momentaneous signal with said calculated signal.

13. A winding apparatus as set forth in claim 12 wherein said speed control of said second drive includes a comparator for receiving said momentaneous signal and said calculated signal and for emitting a connection signal in response to a deviation between said received signals, and an invertor for receiving said correction signal to adjust said second drive in response thereto.

14. A winding apparatus as set forth in claim 12 which further comprises a function generator for receiving said third signal and for emitting said second signal as a function thereof.

* * * * *

UNITED STATES PATENT AND TRADEMARK OFFICE

CERTIFICATE OF CORRECTION

PATENT NO. : 4,049,211

DATED : September 20, 1977

INVENTOR(S) : Gelli Spescha

It is certified that error appears in the above-identified patent and that said Letters Patent are hereby corrected as shown below:

Column 4, line 14, "ofthe" should be -- of the --.

Column 6, line 11, "lay-cut" should be "lay-out"

Column 6, line 40, "Seed" should be "Speed"

Column 6, line 62, insert digital before tachometer

Column 7, line 18 u should be ü

Column 11, line 49, u should be ü

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*